US005542615A

United States Patent [19]

Yu et al.

[11] Patent Number: 5,542,615

[45] Date of Patent: Aug. 6, 1996

[54] PULVERIZING APPRATUS

[75] Inventors: Liangzhong Yu; Zigiang Wang, both of Wuhan, China

[73] Assignee: Wuhan University of Technology, Wuhan, China

[21] Appl. No.: 56,990

[22] Filed: May 3, 1993

[30] Foreign Application Priority Data

May 3, 1992 [CN] China ..... 92 2 09032.7

[51] Int. Cl.[6] ..... B02C 13/14; B02C 23/24

[52] U.S. Cl. ..... 241/57; 241/79.1; 241/199.12; 241/278.1

[58] Field of Search ..... 241/79.1, 199.12, 241/278.1, 284, 57

[56] References Cited

U.S. PATENT DOCUMENTS

| | | | |
|---|---|---|---|
| 3,302,895 | 2/1967 | Ryder | 241/284 |
| 4,238,078 | 12/1980 | Yagupov | 241/46.02 |
| 4,739,937 | 4/1988 | Carpenter, Jr. et al. | 241/79.1 |
| 4,905,918 | 3/1990 | Selles et al. | 241/39 |
| 4,913,359 | 4/1990 | Satomi | 241/57 |
| 5,048,765 | 4/1991 | Satomi | 241/62 |
| 5,236,133 | 8/1993 | Lundquist | 241/19 |

FOREIGN PATENT DOCUMENTS

| | | | |
|---|---|---|---|
| 1715404 | 2/1992 | U.S.S.R. | 241/278.1 |

*Primary Examiner*—John Husar
*Attorney, Agent, or Firm*—Jones, Day, Reavis & Pogue

[57] ABSTRACT

A pulverizing apparatus comprising: a grinding chamber formed between the inlet of materials and the outlet of the materials with bearings at the bottom, a shaft supported in the bearings extending into the grinding chamber and being driven by a motor, a conical plate mounted on the shaft with more than one radial blades or radial hammer plates on its inner surface, a powder selector, an air-blower and an air duct connecting the blower with the grinding chamber, the air vent of said air duct located above the conical plate. The pulverizing apparatus merges hammer pulverization, impact pulverization and power self-grind into a whole, which simultaneously finishes intermediate crush, fine crush and grinding materials, and which can improve the fineness and transmit the unfinished product into a selecting system by creating the high speed vortex.

21 Claims, 4 Drawing Sheets

PULVERIZING APPRATUS

FIELD OF THE INVENTION

The present invention relates to pulverizing apparatus, particularly to pulverizing apparatus for pulverizing medium sized materials into very small particles. This pulverizing apparatus merges hammer pulverization, impact pulverization, and power self-grind into a whole.

BACKGROUND OF THE INVENTION

In the prior arts, the grinding ore process from raw material into product needs several procedures such as rough crush, intermediate crush, fine crush and grind. The hammer-crush machine and the impacting-crush machine are generally used for the intermediate and fine crush. The ball mill and the roller mill are used for grind. Therefore, various machines have to be used and the various procedures have to be taken, and a lot of grinding medium may be consumed, during the intermediate crush, fine crush and grind.

A power self-grinding machine as disclosed in U.S. Pat. No. 4,176,795 includes a vertical shaft mounted with a bowl-shaped rotor which is divided into sections by vertical partitions for pushing materials. Unfinished broken materials and water are in the grinding chamber. When the shaft drives and the bowl-shaped rotor rotates with high speed, self-grinding of material occurs, and the broken materials are mixed with water to form thick liquid and then flow into the sorting system.

A pulverizer apparatus as disclosed in U.S. Pat. No. 3,303,895 includes a conical plate (cone) which is mounted on a vertical shaft. There are flanges for hammering ore on the surface of the plate. Air-mouth is below the conical plate. When working, the flanges on the plated surface strike and break ore and the air-flow from air mouth blows the broken ore into the powder selector on the top of the grinder.

A power self-grinder for self grinding process as disclosed in U.S. Pat. No. 4,905,918 includes the air vents, which makes a certain angle with the horizontal bottom of the chamber, to blow-up unfinished broken ore near the bottom of the chamber. The unfinished broken ore is blowed up by air-flow with high speed from air vents to realize the self-grinding

SUMMARY OF THE INVENTION

The objective of the present invention is to provide a pulverizing apparatus, which merges hammer pulverization, impact pulverization and power self-grind into a whole, which simultaneously finishes intermediate crush, fine crush and grinding materials, and which can improve the fineness and transmits the unfinished product into selecting system by using the high speed vortex.

The present invention provides a pulverizing apparatus which comprises a grinding chamber formed between the inlet of materials and the outlet of the materials with bearings at the bottom, a shaft supported in the bearings extending into the grinding chamber and being driven by a motor, a conical plate mounted at its apex on the shaft with more than one radial blades or radial hammer plates on its inner surface, a powder selector, an air-blower and an air duct connecting the blower with the grinding chamber, characterized in that the air vent of said air duct is located above the conical plate.

A preferred selection for the pulverizing apparatus is that said air duct is around the grinding chamber and connected with the grinding chamber through more than one air vents, wherein the angle between the center line of an air vent and the normal line at the point of the circumference of the inner wall of the grinding chamber (at which said center line passes through) is an acute one. The angles are better larger than 60 degrees and as near as possible to 90 degrees. The air vents are better uniformly distributed along the circumference of the inner wall of the grinding chamber. In order to complete self-grind, the air-flow better goes into the grinding chamber with high speed. The speed of the air-flow is better larger than or at least near the tangent speed at the maximal circumference of the conical plate.

Another preferred selection for pulverizing apparatus is that the air duct goes into the grinding chamber from above the conical plate, for example from the top of the grinding chamber, the air vent of the air duct is located immediately above the conical plate and faces the conical plate, and the distance between the air vent to the top of the conical plate is not more than ⅕ of the length of the grinding chamber.

To obtain more momentum of the processed ore, and to keep the temperature not too high and to reduce the wear of the machine, it is better for the tangent speed at the maximal circumference of the conical plate to be 30–50 m/sec.

To provide enough space for ore self-grind, the ratio of the grinding chamber length between the top surface of the conical plate and the inlet of material to the diameter is better greater than ½.

To prevent the unfinished broken ore from falling down the space between the rotating conical plate and the bottom of the grinding chamber and from causing the plate to be blocked, more than one groove is provided along the generating line on the conical plate and there is a strike-off board in each groove, which stretches into the space between the conical plate and the bottom of the grinding chamber.

The advantageous effects of the present invention are both that the conical plate with high speed strike the broken ore by the hammer plates on the conical plate and the unfinished ore obtains higher centrifugal force, and that the unfinished ore and air-flow obtain high normal speed and high tangent speed along the circumference so that the rotating vortex with high speed is formed to realize self-grinding. Therefore, the present invention reduces and simplifies the technological process and merges the intermediate, fine grinding and grinding ore into a whole, economizes the cost of the equipment and energy sources and improves the purity and quality of the product.

DETAILED DESCRIPTION OF THE DRAWINGS

Figure 1:
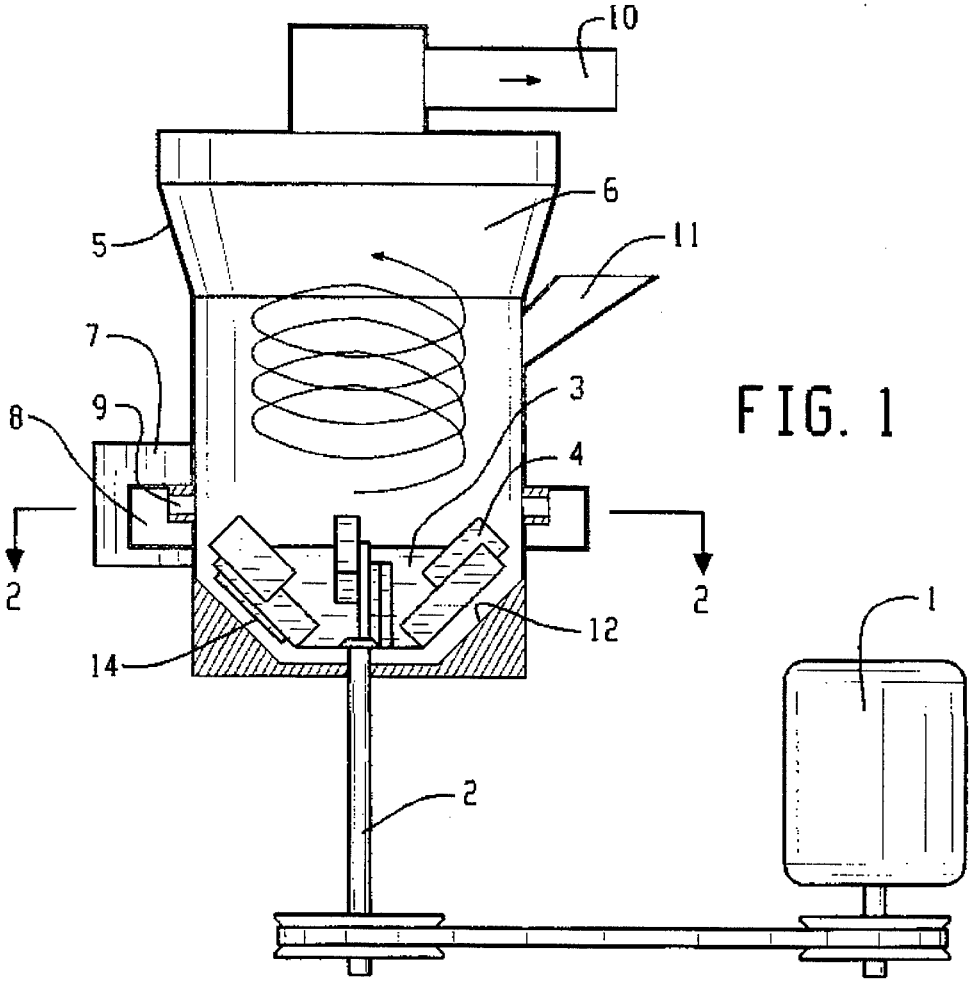
FIG. 1 is the structural diagrammatic sketch showing the pulverizing apparatus with loop air duct.

In order to better explain the structure and the strong points of the invention, the embodiments for the invention are described in detail and with the drawings below.

The reference numerals in the drawings correspond to the parts as follows: 1-motor, 2-shaft, 3-conical plate, 4-hammer plate, 5-grinding chamber, 6-powder selector, 7-air blower, 8-air duct, 9-air vent, 10-outlet, 11-inlet, 12-bottom of grinding chamber, 13-groove, 14-strike-off board, 15-space.

Figure 4:
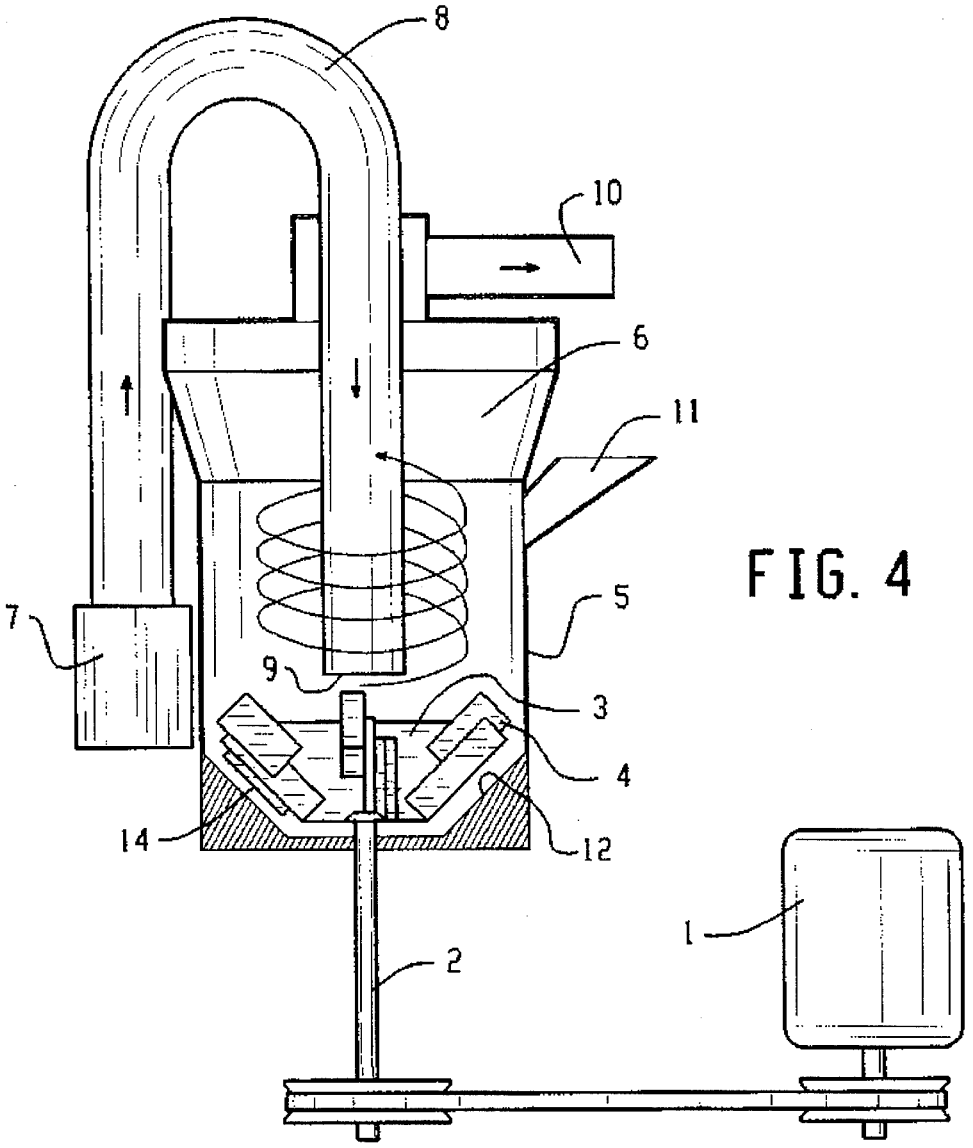
FIG. 4 is the structural diagrammatic sketch showing the pulverizing apparatus with a central duct.

Referring to FIG. 1 and FIG. 4, conical plate 3 is a centrifugal plate which can contain ore materials and rotate about the vertical shaft 2. The contour of the plate is an inverted truncated cone. A bottom is fixed at the smaller end of the conical plate. The conical plate is in the lower part of the grinding chamber and is mounted on the shaft 2 which is driven by the motor 1. There are a inlet 11 and a outlet 10 of the material, a powder selector 6, a air loop air duct 8 (in FIG. 1) or a central air duct 8 (in FIG. 4), a grinding chamber 5 formed between the bottom of the grinding chamber 12 and the powder selector 6, an air blower 7 connected with the air duct 8, and the air vents 9 of the air duct through which the high speed air can go into the grinding chamber.

Figure 2:
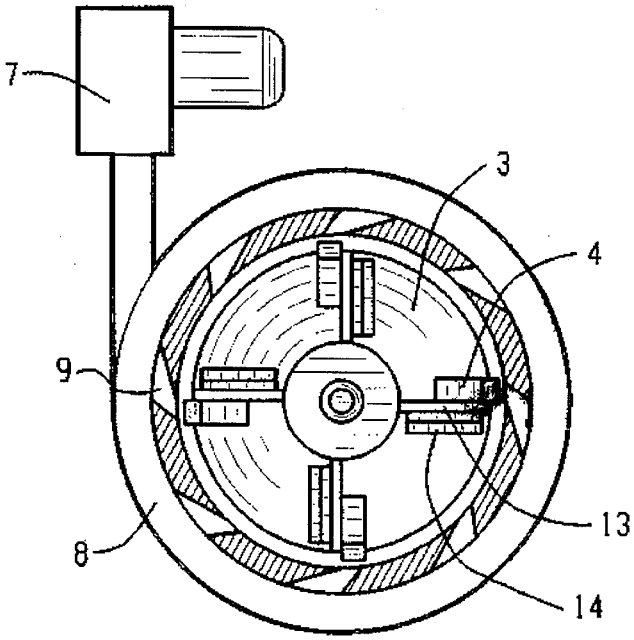
FIG. 2 is a cross-sectional view taken through A—A in FIG. 1.
Figure 3A:
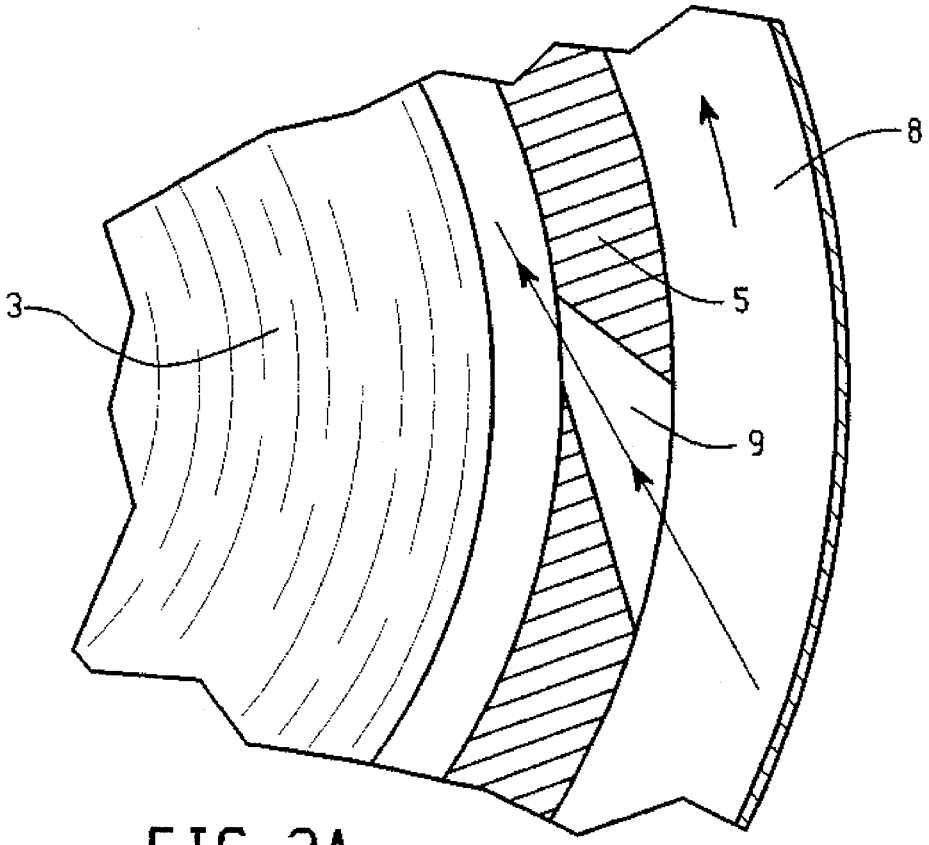
FIG. 3A and B are the diagrammatic sketches showing the connection between the air vents and the grinding chamber.
Figure 3B:
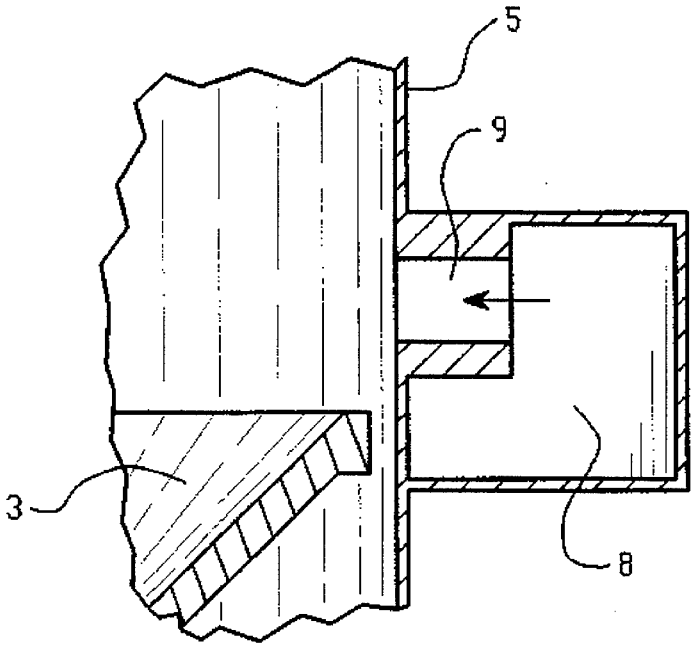
Figure 5:
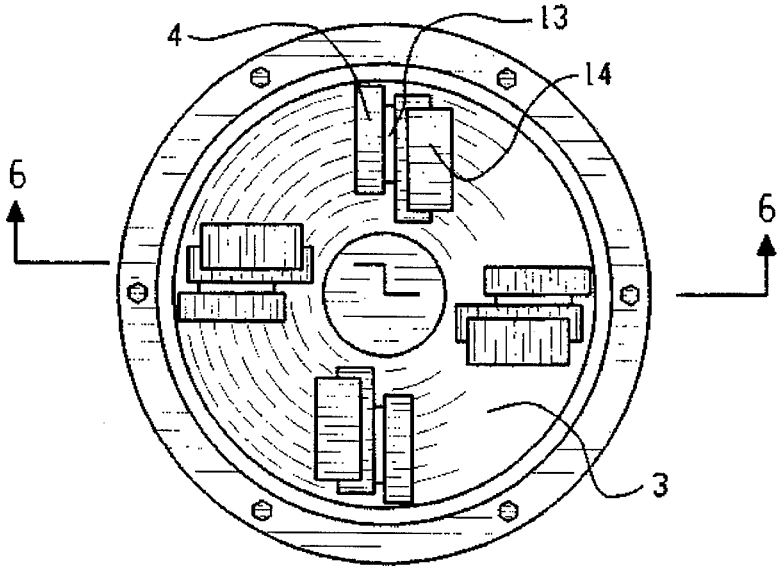
FIG. 5 is the top plan view of the conical plate with strike-off boards.
Figure 6:
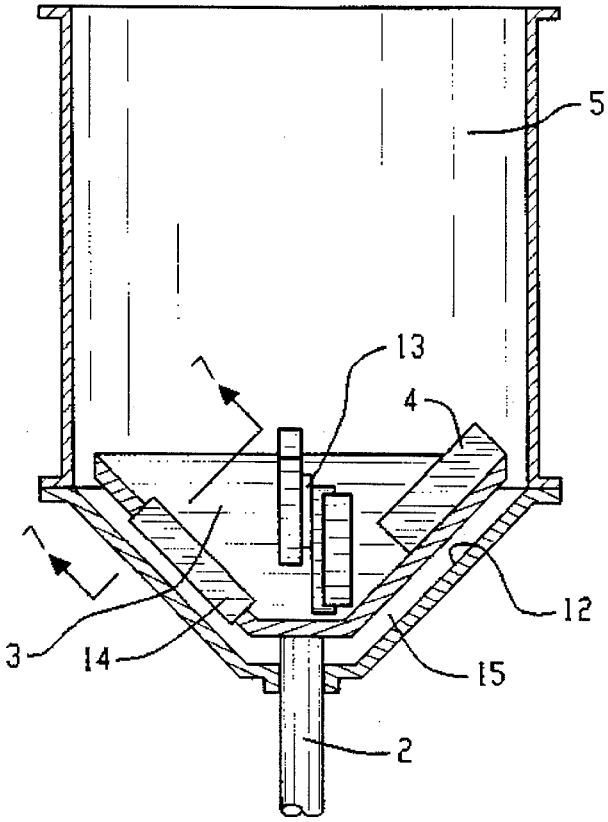
FIG. 6 is the cross-sectional view taken through B—B in FIG. 5.

Referring to FIG. 2, FIG. 5, FIG. 6, four hammer plates 4 are uniformly and circumferentially installed on the inner surface of conical plate 3, along the generating line and vertically to the inner surface of the conical plate. The hammer plates are detachable.

Figure 7:
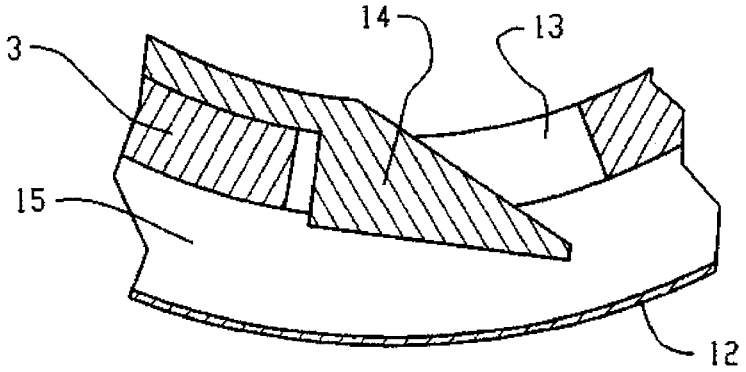
FIG. 7 is the cross-section view taken through C—C in FIG. 6.

Referring to FIG. 5, FIG. 6 and FIG. 7, there are groove 13 along the generating line on the conical plate, strike-off board 14 fixed in the groove is a rectangular metal flat, one side of which is fixed on the side of groove 13 and the other side of which is half-wedge-shaped and stretches into space 15 between conical plate 3 and bottom 12 of the grinding chamber. The stretched length should ensure that strike-off board 14 does not run into bottom 12 of the grinding chamber, when conical plate 3 is rotating. When conical plate 3 rotates and pushes ore materials, the materials falling-down in the space 15 between conical plate 3 and bottom 12 of the grinding chamber will be pushed back to the top surface (inner surface of conical plate 3) by strike-off board 14 through the groove 13. Therefore, space 15 between conical plate 3 and bottom 12 of the grinding chamber will not be filled up with ore materials to cause blocking.

Referring to FIGS. 1, FIG. 2, FIG. 3A and FIG. 3B, powder selector 6 is in on the top of cylindrical grinding chamber 5. The sieved product is transmitted out through outlet 10 of the materials. There is inlet 11 of the materials on the wall of the grinding chamber. The cross-selection of the air vent 9 is semi-ring-shaped or rectangular, is horizontally round the outside wall of the grinding chamber 5. There are openings used for air vent in the wall of the grinding chamber 5, so that the air duct 8 can be connected with the grinding chamber 5, and the air can go into the grinding chamber 5. The angle between the center line of an air vent and the normal line at the point of the circumference of the inner wall of the grinding chamber (at which said center line passes through) is an acute one. Angle is better as near as possible to 90 degrees, so that the air-flow from air vent 9 approaches the tangent direction of the inner wall of the grinding chamber 5 so that vortex is generated by means of the function of the inner wall. The air vents 9 are uniformly distributed along the circumference of the wall of the cylindrical grinding chamber. The number of the air vents is generally 1 to 8, however, the optimal number is 6 to 8. Conical plate 3 with hammer plate 4 is in the lower part of the grinding chamber 5 and is mounted on the shaft. The linear speed of the conical plate at the external edge of the plate is better over 9 m/sec. The speed in the preferred embodiments is 30–50 m/sec.

Referring to FIG. 4, curved duct 8 stretches into the grinding chamber 5 from above the grinding chamber. The air vent 9 is located immediately above conical plate 3 and faces to it. When air-flow goes into grinding chamber 5 and runs into conical plate 3 with hammer plates 4, a vortex with high speed is generated.

Referring to FIG. 6 and FIG. 7, to prevent the unfinished broken ore materials from falling down the space 15 between the rotating conical plate 3 and the bottom 12 of the grinding chamber and from causing the plate 3 to be blocked, there are more than one grooves 13 provided along the generating line on the conical plate and there is a strike-off board 14 fixed in each groove 13, which stretches into the space 15 between the conical plate 3 and the bottom 12 of the grinding chamber.

The working principle of the present invention is as follows: Large pieces of raw materials transmitted into the grinding chamber through the inlet of the materials are first crushed by the hammer plates 4 at high speed, and the broken materials fly off against the wall of the grinding chamber and are again stricken by the wall (the intermediate and fine grinding are finished). The crushed materials are self-ground when they go up spirally in the inner wall of the grinding chamber with high kinetic energy. The speed of larger pieces of materials gradually decrease and they separate themselves from the wall and fall under the promotion of the ascending materials from the bottom. They are strike again and thrown off when they fall down on the surface of conical plate 3. They move in circles until they are ground into small particles. The small particles move up spirally along the wall under driving of the vortex and the fineness is improved. The small particles driven by air-flow pass through the powder selector 6 and outlet 10 and finally go into selecting system.

The experiment demonstrates that this pulverizing apparatus provided in the invention has the function to merge intermediate crush, fine crush, grind, and powder selecting into a whole, so that the processing procedure and the process flow are reduced and simplified. Particularly, the ratio of crushing to grinding is higher. Generally the lumpiness of the in-feed ore is 150 mm, the highest can be 250 mm. In contrast with it, the in-feed lumpiness for ball mill and oscillating mill is only 20–40 mm. The particle fineness of the product provided in the invention can be 60–325 Meshes (a unit describing size of powder, it implies the hole number square inch area of sifter) and the output is 1–5 tons/hr.

We claim:

1. A pulverizing apparatus comprising:

a grinding chamber having a material inlet and a bottom;

a conical plate with more than one radial blades on its inner surface, rotatably supported in said grinding chamber and connecting therewith with a space between the conical plate and the bottom;

a material outlet arranged on said chamber and connecting therewith above said conical plate;

an air-blower communicating with said chamber through an air duct wherein said air duct includes an air vent located above the conical plate so as to produce a vortex of air within said chamber;

more than one grooves are formed along the generating line on the conical plate and a strike-off board is arranged to fix in each groove, which stretches into the space between the conical plate and the bottom of the grinding chamber.

2. A pulverizing apparatus as claimed in claim 1, wherein said air duct is around the grinding chamber and connected with the grinding chamber through more than one air vents, wherein the angle between the center line of an air vent and the normal line at the point of the circumference of the inner wall of the grinding chamber at which said center line passes through is an acute one.

3. A pulverizing apparatus as claimed in claim 2, wherein the air vents are uniformly distributed along the circumference of the inner wall of the grinding chamber.

4. A pulverizing apparatus as claimed in claim 3 wherein the speed of the air at the air vent is from 30 to 50 m/sec.

5. A pulverizing apparatus as claimed in claim 4 wherein the linear speed of the conical plate at the external edge of the plate is 30–50 m/sec.

6. A pulverizing apparatus as claimed in claim 4 wherein the ratio of the length of the grinding chamber from the top surface of the conical plate to the material inlet to the diameter of the grinding chamber is greater than ½.

7. A pulverizing apparatus as claimed in claim 3 wherein the linear speed of the conical plate at the external edge of the plate is 30–50 m/sec.

8. A pulverizing apparatus as claimed in claim 3 wherein the ratio of the length of the grinding chamber from the top surface of the conical plate to the material inlet to the diameter of the grinding chamber is greater than ½.

9. A pulverizing apparatus as claimed in claim 2 wherein the speed of the air at the air vent is from 30–50 m/sec.

10. A pulverizing apparatus as claimed in claim 9 wherein the linear speed of the conical plate at the external edge of the plate is 30–50 m/sec.

11. A pulverizing apparatus as claimed in claim 10 wherein the ratio of the length of the grinding chamber from the top surface of the conical plate to the material inlet to the diameter of the grinding chamber is greater than ½.

12. A pulverizing apparatus as claimed in claim 9 wherein the ratio of the length of the grinding chamber from the top surface of the conical plate to the material inlet to the diameter of the grinding chamber is greater than ½.

13. A pulverizing apparatus as claimed in claim 2 wherein the linear speed of the conical plate at the external edge of the plate is 30–50 m/sec.

14. A pulverizing apparatus as claimed in claim 2 wherein the ratio of the length of the grinding chamber from the top surface of the conical plate to the material inlet [of material] to the diameter of the grinding chamber is greater than ½.

15. A pulverizing apparatus as claimed in claim 1, wherein the air duct goes into the grinding chamber from above and that said air vent is located above the conical plate and faces to the conical plate.

16. A pulverizing apparatus as claimed in claim 15, wherein the distance between the air vent and the conical plate is not more than ⅕ of the length of the grinding chamber.

17. A pulverizing apparatus as claimed in claim 16 wherein the linear speed of the conical plate at the external edge of the plate is 30–50 m/sec.

18. A pulverizing apparatus as claimed in claim 16 wherein the ratio of the length of the grinding chamber from the top surface of the conical plate to the material inlet to the diameter of the grinding chamber is greater than ½.

19. A pulverizing apparatus as claimed in claim 15 wherein the linear speed of the conical plate at the external edge of the plate is 30–50 m/sec.

20. A pulverizing apparatus as claimed in claim 15 wherein the ratio of the length of the grinding chamber from the top surface of the conical plate to the material inlet to the diameter of the grinding chamber is greater than ½.

21. A pulverizing apparatus as claimed in claim 1 wherein the linear speed of the conical plate at the external edge of the plate is 30–50 m/sec.

* * * * *